US011542118B2

(12) United States Patent
Kattainen

(10) Patent No.: US 11,542,118 B2
(45) Date of Patent: Jan. 3, 2023

(54) BRAKE CONTROL APPARATUS AND A METHOD OF CONTROLLING AN ELEVATOR BRAKE

(71) Applicant: KONE Corporation, Helsinki (FI)

(72) Inventor: Ari Kattainen, Helsinki (FI)

(73) Assignee: KONE Corporation, Helsinki (FI)

( * ) Notice: Subject to any disclaimer, the term of this patent is extended or adjusted under 35 U.S.C. 154(b) by 1439 days.

(21) Appl. No.: 15/709,104

(22) Filed: Sep. 19, 2017

(65) Prior Publication Data

US 2018/0002138 A1 Jan. 4, 2018

Related U.S. Application Data

(63) Continuation of application No. PCT/FI2015/050232, filed on Apr. 1, 2015.

(51) Int. Cl.

| | |
|---|---|
| ***B66B 1/32*** | (2006.01) |
| ***B66B 5/00*** | (2006.01) |
| ***B66B 5/02*** | (2006.01) |

(52) U.S. Cl.

CPC ..... *B66B 1/32* (2013.01); *B66B 5/0031* (2013.01); *B66B 5/02* (2013.01)

(58) Field of Classification Search

CPC ..... B66B 1/32; B66B 5/0031; B66B 5/0018
See application file for complete search history.

(56) References Cited

U.S. PATENT DOCUMENTS 5,590,013 A * 12/1996 Harasawa ..... H01H 47/32 361/187
9,617,117 B2 * 4/2017 Rogers ..... B66B 5/0031
9,778,319 B2 * 10/2017 Edwards ..... G01R 19/16566
9,810,742 B2 * 11/2017 Giordano ..... G01R 31/006
10,065,832 B2 * 9/2018 Kubota ..... B66B 5/02
2006/0137941 A1 6/2006 Andrejak et al.
2007/0187185 A1 8/2007 Abraham et al.
2009/0223746 A1 9/2009 Takahashi et al.
2010/0282545 A1 11/2010 Ueda
(Continued)

FOREIGN PATENT DOCUMENTS

CN 1796260 A 7/2006
CN 103842277 A 6/2014
EP 1 997 764 A1 12/2008
(Continued)

OTHER PUBLICATIONS

Office Action issued in related Chinese Application No. 201580078426.1 dated Aug. 28, 2018.

*Primary Examiner* — Christopher Uhlir
(74) *Attorney, Agent, or Firm* — Birch, Stewart, Kolasch & Birch, LLP

(57) ABSTRACT

The invention concerns a brake control apparatus and a method of controlling an elevator brake. The brake control apparatus comprises a first switch and a second switch connected in series with each other for selectively supplying current from a power source to an electrically operated actuator of an elevator brake. The control pole of the first switch and the control pole of the second switch are associated with an elevator safety circuit. The brake control apparatus further comprises a first monitoring circuit configured to indicate operation of the first switch and a second monitoring circuit configured to indicate operation of the second switch.

12 Claims, 6 Drawing Sheets

(56) References Cited

U.S. PATENT DOCUMENTS

| | | | | |
|---|---|---|---|---|
| 2011/0198167 | A1* | 8/2011 | Huppunen | B66B 5/0031<br>188/171 |
| 2013/0233657 | A1* | 9/2013 | Kattainen | H02P 15/00<br>188/156 |

FOREIGN PATENT DOCUMENTS

| | | | |
|---|---|---|---|
| EP | 2 886 499 | A1 | 6/2015 |
| JP | 2008-81226 | A | 4/2008 |

* cited by examiner

BRAKE CONTROL APPARATUS AND A METHOD OF CONTROLLING AN ELEVATOR BRAKE

CROSS REFERENCE TO RELATED APPLICATIONS

This application is a Continuation of PCT International Application No. PCT/FI2015/050232, filed on Apr. 1, 2015, which is hereby expressly incorporated by reference into the present application.

FIELD OF THE INVENTION

The present invention is related generally to the field of elevator brake control and in particular to solutions for supervising operational safety of elevator brake controllers.

BACKGROUND

An electromagnetic brake may be used for braking of an elevator car or a hoisting machine of an elevator, for example.

The electromagnetic brake usually includes a stationary brake body and an armature arranged to move relative to the brake body. A spring or corresponding is fitted between the brake body and the armature to apply a thrust force between them. Additionally, an electrically operated actuator is fitted inside the brake body to selectively open or apply the brake.

In some embodiments the electrically operated actuator is an electromagnet with a magnetizing coil. Brake is disposed in the proximity of an object to be braked, such as a traction sheave of a hoisting machine or a guide rail of an elevator. The brake is applied by driving the armature against the object by means of the thrust force of the spring. Brake is opened by energizing the magnetizing coil. When energized, magnetizing coil causes attraction between the brake body and the armature, which further causes armature to disengage the braked object by resisting thrust force of the spring.

A brake controller may be used to selectively open or close the brake. Brake is opened by feeding current to the magnetizing coil and applied by interrupting the supply of current to the magnetizing coil, according to commands from elevator control. In normal operation, brake is opened when starting a new elevator run and brake is applied at the end of the run.

The brake controller comprises safety relays or contactors, which have a specific structure to fulfill elevator safety regulations. This specific structure of the safety relays/contactors also means that they are large-sized and expensive.

In view of the foregoing, there is a need for low-cost, small-sized elevator brake controllers.

AIM OF THE INVENTION

It is the objective of this invention to introduce a new low-cost and small-sized elevator brake control apparatus. Therefore the invention discloses a brake control apparatus according to claim 1.

Another objective of the invention is to introduce a method of supervising elevator brake controller safety. Therefore the invention discloses a method of controlling an elevator brake according to claim 15.

Some preferred embodiments of the invention are described in the dependent claims. Some inventive embodiments, as well as inventive combinations of various embodiments, are presented in the specification and in the drawings of the present application.

SUMMARY OF THE INVENTION

An aspect of the invention is a brake control apparatus, comprising a first switch and a second switch connected in series with each other for selectively supplying current from a power source to an electrically operated actuator of an elevator brake. The control pole of the first switch and the control pole of the second switch is associated with an elevator safety circuit. The brake control apparatus comprises a first monitoring circuit configured to indicate operation of the first switch and a second monitoring circuit configured to indicate operation of the second switch. This means that operation of the brake control apparatus can be monitored with two separate circuits, utilizing an advantageous monitoring sequence, such that operation reliability and safety of the brake controller may be improved.

According to one or more embodiments, the second monitoring circuit is configured to indicate operation of the first switch while the second switch is open. This means that operation of the first switch can be monitored with two separate circuits, therefore providing a monitoring result with higher reliability.

According to one or more embodiments, the first switch is a change-over switch and the second switch is a change-over switch.

According to one or more embodiments, the first change-over switch and the second change-over switch have their inputs as well as first outputs in the current supply path. The second output of the first change-over switch in coupled to the first monitoring circuit, and the second output of the second change-over switch is coupled to the second monitoring circuit. This means that each monitoring circuit may be implemented with the corresponding changeover switch, therefore resulting in a simple and low-cost monitoring circuit configuration.

As the control pole of the first switch and the second switch is associated with an elevator safety circuit, the first switch and the second switch may be operated according to (safety) status information from the elevator safety circuit.

In the disclosure, the term "first/second/third switch is open" means that said first/second/third switch is in a state that prevents supply of current through said first/second/third switch to an electrically operated actuator of an elevator brake. Accordingly, the term "first/second/third switch is closed" means in the disclosure that said first/second/third switch is in a state that allows supply of current through said first/second/third switch to an electrically operated actuator of an elevator brake.

According to one or more embodiments, the first monitoring circuit and the second monitoring circuit are configured to indicate opening and closing of the first switch while the second switch is open. This enables a monitoring procedure wherein second switch is opened first, causing interruption of current to an electrically operated actuator of an elevator brake, and after this the first switch is further opened; opening of the first switch is then monitored with both first and second monitoring circuits. According to one or more embodiments, the second monitoring circuit is configured to indicate opening of the first switch only when the second switch is open.

According to one or more embodiments, the brake control apparatus comprises a processor and a memory with a processor-implemented monitoring program stored therein.

The processor has inputs coupled to the first monitoring circuit and to the second monitoring circuit as well as an output associated with the control pole of the second switch. The monitoring program comprises instructions for comparing operation data of the first switch as received from the first monitoring circuit and the operation data of the first switch as received from the second monitoring circuit to a monitoring criteria, and for indicating an operational anomaly when the operation data does not fulfill the monitoring criteria.

According to one or more embodiments, the processor has an output for selectively sending a start permit signal to the safety circuit, and in that the monitoring program comprises instructions for sending a start permit signal when the operation data fulfills the monitoring criteria. The start permit signal may be transferred to elevator safety circuit to indicate that the brake control apparatus is operational and next elevator start is possible. On the other hand, lack of start permit signal may indicate to elevator safety circuit that an operational anomaly is present in the brake control apparatus and therefore next elevator start should be prevented.

According to one or more embodiments, the brake control apparatus comprises a rectifier fitted into the current supply path, for rectifying AC current to DC current for the electrically operated actuator of an elevator brake. The first switch is fitted to AC side of the rectifier and the second switch is fitted to DC side of the rectifier.

According to one or more embodiments, the brake control apparatus comprises a third switch. Accordingly, there are two elevator brakes each having an electrically operated actuator operable to selectively open or apply the elevator brake. The third switch is connected in series with the first switch for selectively supplying current from power source to one of the electrically operated actuators, independent of the switching state of the second switch. The second switch is connected in series with the first switch for selectively supplying current from power source to the other of electrically operated actuators, independent of the switching state of the third switch. This means that both elevator brakes may be controlled independent of each other, e.g. both brakes may be opened one at a time while the other brake remains applied. This kind of solution is useful for testing braking force of the elevator brakes one at a time, for example. According to one or more embodiments, the brake control apparatus comprises a third monitoring circuit configured to indicate operation of the third switch. In a preferred embodiment, first, second and third switch are change-over switches having their inputs as well as first outputs in the current supply path. The second output of the first switch in coupled to the first monitoring circuit, the second output of the second switch is coupled to the second monitoring circuit and the second output of the third switch is coupled to the third monitoring circuit. This means that each monitoring circuit may be implemented with the corresponding changeover switch in simple and low-cost manner. In the most preferred embodiment the first, the second and the third switch are relays having change-over switch contact configuration. Preferably, each relay has two change-over switch configurations, which may be connected in series to improve electrical isolation properties of the switch. This kind of two change-over switch configuration is commonly available for commercial relays. Preferably, the safety circuit is coupled to the control coil of the first relay, the second relay and the third relay for supplying current to the control coils of the first, second and third relay, and the control coils of the second relay and the third relay are coupled to electrical reference ground via transistors, and outputs of the processor are coupled to the transistors for controlling the second and third relay. In some embodiments, the control coil of the first relay is also coupled to electrical reference ground via a transistor, and an output of the processor is coupled to the transistor for controlling the first relay.

According to one or more embodiments, the first switch is fitted in the current supply path closer to the power source than the second switch and the third switch. Therefore current supply to electrically operated actuators of both elevator brakes can be interrupted at the same time, by opening the first switch. This means that opening of the first switch has the effect that both elevator brakes are applied.

According to one or more embodiments, the electrically operated actuator is an electromagnet of an electromagnetic brake. The electromagnet comprises a magnetizing coil. Current to the magnetizing coil is supplied with the brake control apparatus.

Another aspect of the invention is a method of controlling an elevator brake. The method comprises:

a) causing, responsive to a control signal from a safety circuit, a first switch to close for supplying power from power source to an electrically operated actuator of an elevator brake, b) measuring, by a first monitoring circuit, operation of the first switch c) measuring, by a second monitoring circuit, operation of the first switch, and d) comparing, by a computer, the measuring data received from the first monitoring circuit and the second monitoring circuit to a monitoring criteria valid when a second switch is open.

According to one or more embodiments, after step d), causing, by the computer, the second switch to close for supplying power from power source to an electrically operated actuator of an elevator brake, if the measuring data received from the first monitoring circuit and the second monitoring circuit fulfills the monitoring criteria.

According to one or more embodiments, after step a) and before step b), causing, by a computer, a second switch to open for interrupting power supply from power source to an electrically operated actuator of an elevator brake.

According to one or more embodiments, after causing the second switch to open, and before step b), further causing, responsive to a control signal from a safety circuit, a first switch to open for interrupting power supply from power source to an electrically operated actuator of an elevator brake.

According to one or more embodiments, after step d), sending, by the computer, to the safety circuit a start permit signal when the operation data fulfills the monitoring criteria.

According to one or more embodiments, after step d), indicating, by the computer, an operational anomaly if the measurement data does not fulfill the monitoring criteria.

According to one or more embodiments, the brake control apparatus comprises a dissipation circuit configured to interrupt magnetizing coil current while the second switch is open. This means that interruption of magnetizing coil current may be speeded up by dissipating at least some of the inductive energy of the magnetizing coil in the dissipation circuit. Use of dissipation circuit may be beneficial in emergency stop situation, when magnetizing coil current should be interrupted and elevator brake should be applied as soon as possible.

The invention makes it possible to use relays with change-over contacts, which relays are used traditionally in nonsafety applications, for a safety application, e.g. for selectively supplying current to an electrically operated actuator of an elevator brake. Therefore the invention eliminates need for specific safety relays/contactors.

BRIEF DESCRIPTION OF THE DRAWINGS

In the following, the invention will be described in more detail by the aid of some examples of its embodiments, which in themselves do not limit the scope of application of the invention, with reference to the attached drawings, wherein.

MORE DETAILED DESCRIPTION OF PREFERRED EMBODIMENTS OF THE INVENTION

For the sake of intelligibility, in FIGS. 1-6 only those features are represented which are deemed necessary for understanding the invention. Therefore, for instance, certain components/functions which are widely known to be present in corresponding art may not be represented.

In the description same references are always used for same items.

First Embodiment

Figure 1:
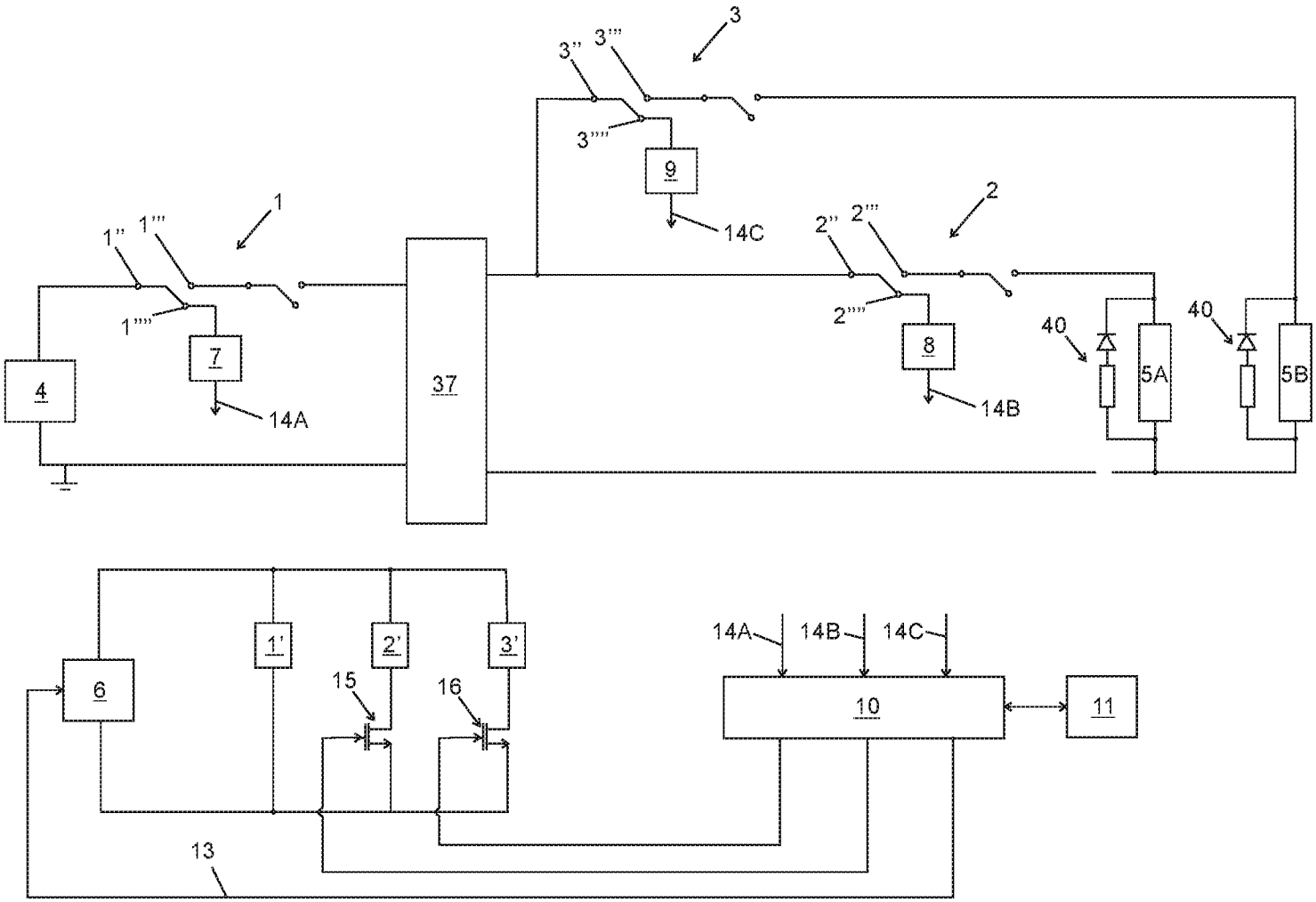
FIG. 1 shows a brake control apparatus according to an exemplary embodiment.

FIG. 1 is a schematic of a main circuit of a brake control apparatus according to an exemplary embodiment. As is known, electromagnetic brakes are used in elevator systems for braking movement of elevator car or hoisting machine driving an elevator car, for example. Preferably two separate brakes are used to enhance safety, e.g. if one brake fails the other is still available for braking movement of the elevator car. The electromagnetic brake is opened by feeding sufficient amount of DC current to the magnetizing coil 5A, 5B, and the electromagnetic brake is applied by interrupting supply of current to the magnetizing coil 5A, 5B. The brake control apparatus of FIG. 1 has a current supply path for supplying current from AC power source 4 (e.g. mains) to magnetizing coils 5A, 5B of two electromagnetic elevator brakes. In some refinements, the brake control apparatus is supplied with one-phase alternating current (AC) system having phase conductor L and neutral conductor N coming from a supply transformer 4 connected to the mains. In some refinements, neutral conductor N is also earthed near the supply transformer 4 (protective earth).

The brake control apparatus comprises a first switch 1, a second switch 2 and a third switch 3. The first switch 1, the second switch 2 and the third switch 3 are low-cost relays having change-over switch configuration. They have their their inputs 1", 2", 3" as well as first outputs 1'", 2'", 3'" in the current supply path. Each relay has a two change-over switch configuration. The two change-over switches of each relay 1, 2, 3 are connected in series to improve current switch-off properties.

Instead of relays 1, 2, 3 also solid-state switches such as mosfet-transistors or igbt-transistors could be used. In some refinements a combination of relays and solid-state switches may be used.

The second relay 2 is connected in series with the first relay 1 for selectively supplying current from the mains 4 to the first magnetizing coil 5A. The third relay 3 is connected in series with the first relay 1 for selectively supplying current from the mains 4 to the second magnetizing coil 5B. A rectifier 37 is fitted to the current path to supply DC current to the magnetizing coils 5A, 5B. First relay 1 is fitted to AC side of the rectifier 37 and second and third relay 2, 3 and fitted to DC side of rectifier 37. As can be seen from FIG. 1, the second relay 2 and the third relay 3 may supply current to the magnetizing coils 5A, 5B independent of each other, such that both magnetizing coils 5A, 5B may be energized and de-energized separately and therefore the elevator brakes may be applied and opened independently. This is advantageous for example when testing braking force of the independent brakes by opening the brakes one at a time.

Further, the brake control apparatus comprises monitoring circuits 7, 8, 9 for indicating operation states (e.g. open/close states) of the change-over relays 1, 2, 3. The first monitoring circuit 7 is coupled to the second output 1"" of the first relay 1 and is configured to read voltage status (e.g. voltage on/voltage off) of the second output 1"". The second monitoring circuit 8 is coupled to the second output 2"" of the second switch 2 and is configured to read voltage status of the second output 2"". The third monitoring circuit 9 is coupled to the second output 3"" of the third relay 3 and is configured to read voltage status of the second output 3"". Each monitoring circuit 7, 8, 9 comprises a resistor connected in series with an optocoupler to isolate the monitoring signal 14A, 14B, 14C from the mains 4. When the relay 1, 2, 3 opens or closes, voltage status in the corresponding second output 1"", 2"", 3"" changes and opening/closing of the relay 1, 2, 3 can be read from the monitoring signal 14A, 14B, 14C.

Further, because of the advantageous topology of the brake control apparatus of FIG. 1, the second 8 and third 9 monitoring circuits may be used for monitoring operation of the first relay 1 when the second relay 2 and the third relay 3 are open. At the same time, the advantageous monitoring sequence also provides monitoring of second 2 and third 3 relays, by comparing results of second 8 and third monitoring 9 circuits when first relay 1 is operated. Therefore, a high level of safety may be achieved with the brake control apparatus of FIG. 1, even when ordinary low-cost relays 1, 2, 3 are used in current supply paths of the magnetizing coils 5A, 5B.

The brake control apparatus comprises a processor 10 and a memory 11 with a processor 10-implemented monitoring program stored therein. The main processor is preferably the main processor of the inverter of the elevator hoisting motor of the hoisting machine; however it may also be a separate component dedicated to brake control purpose. The processor 10 takes care of control and monitoring functions of the brake control apparatus. Monitoring signals 14A, 14B, 140 from the monitoring circuits 7, 8, 9 are connected to processor 10 inputs.

Control coil 1' of the first relay 1 is coupled to an elevator safety circuit 6. Also control coils 2', 3' of second 2 and third 3 relay are coupled to the elevator safety circuit 6; in addition to this, control coils 2', 3' of second 2 and third 3 relay are coupled to electrical reference ground via transistors 15, 16. Transistors 15, 16 are further coupled to processor 10 outputs such that switching state of second 2 and third 3 relay may be controlled by the processor 10. In come refinements, the safety circuit 6 is implemented with electromechanical safety control components, such as safety contacts and safety relays/contactors. In some refinements, the safety circuit 6 comprises a microprocessor-based safety computer according to elevator safety regulations.

The processor 10 has also an output for selectively sending a start permit signal through a communication channel 13 to the safety circuit 6. The monitoring program comprises instructions for sending a start permit signal when the operation data received from the monitoring circuits 7, 8, 9 fulfills the monitoring criteria.

When the safety circuit 6 indicates that elevator is in safe state, current is supplied from a 24 V power supply to control coils 1', 2', 3'. A dangerous situation in elevator system is notified by interrupting power supply to control coils 1', 2', 3'. This has the effect that relays 1, 2, 3 open to interrupt current to the magnetization coils 5A, 5B of the elevator brakes. Consequently, elevator brakes are applied immediately and elevator car will be stopped. A dangerous situation in elevator system may result, for example, if elevator shaft door opens to elevator shaft or elevator car arrives to end limit switch in elevator shaft.

The operation sequence of the brake control apparatus is disclosed hereinafter in details in connection with three different operating situations: normal elevator start, normal elevator stop and emergency stop of an elevator.

Normal Start

Figure 2:
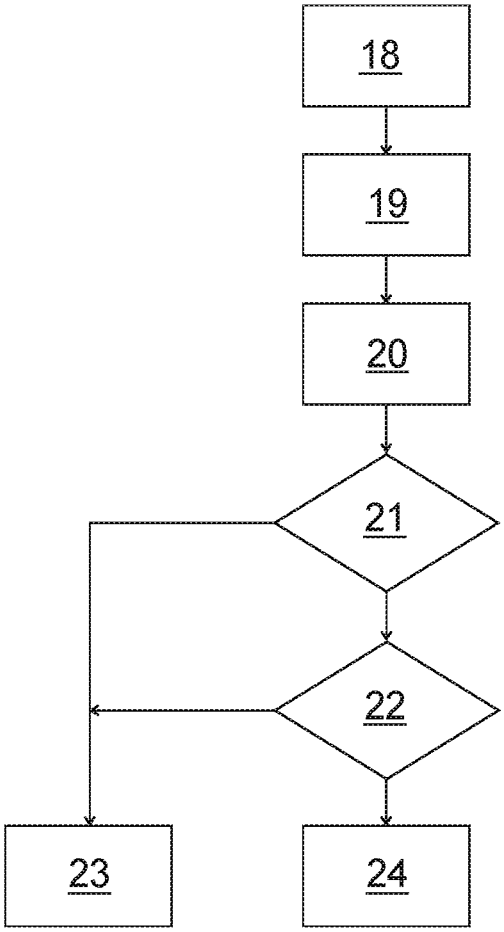
FIG. 2 shows an exemplary brake control sequence when starting a new elevator run.

FIG. 2 shows an exemplary brake control sequence when normal elevator start is issued. In normal start, hoisting motor of elevator car is energized, elevator brakes are opened and elevator car starts a new elevator run according to service request from elevator passengers.

In step 18 of the brake control sequence, processor 10 receives an elevator run start request from elevator traffic controller.

In step 19, elevator safety circuit 6 determines that elevator safety is not endangered, and enables supply of current to control coils 1', 2', 3'.

In step 20, relay 1 closes, conducting mains 4 voltage further to inputs 2", 3" of second 2 and third 3 relays. If the relays 1, 2 and 3 are operating properly, the voltage status in the second outputs 1"", 2"", 3"" changes as follows (on means that mains 4 voltage is present in the corresponding second output 1"", 2"", 3""; off means that mains 4 voltage is not present in the corresponding second output 1"", 2"", 3""):

1"": on→off

2"": off→on

3"": off→on.

In step 21, processor 10 reads the voltage statuses with the monitoring circuits 7, 8, 9. If voltage in all the second outputs 1", 2", 3" changes as required, processor 10 concludes that the relays 1, 2, 3 operate properly. Then the processor 10 controls hoisting motor inverter to energize the hoisting motor. At the same time processor 10 controls transistors 15 and 16 to cause relays 2 and 3 close, thereby energizing the magnetizing coils 5A, 5B to open elevator brakes. After this the normal start sequence proceeds to step 22.

On the other hand, if processor determines that signal status of one or more of the second outputs 1"", 2"", 3"" does not change as required, processor 10 determines a brake control failure and proceeds to step 23 wherein processor cancels elevator operation and sends a fault-indicating signal to safety circuit 6 via the communication channel 13 (or rejects sending of start permit signal).

In step 22, processor 10 reads the voltage statuses of the second outputs 2"", 3"" with the monitoring circuits 8 and 9. If voltage status in both second outputs changes from on to off, processor 10 concludes that the relays 2 and 3 operate properly and normal start may proceed (step 24). Otherwise processor 10 determines a brake control failure and proceeds to step 23 to cancel elevator start.

Normal Stop

Figure 3:
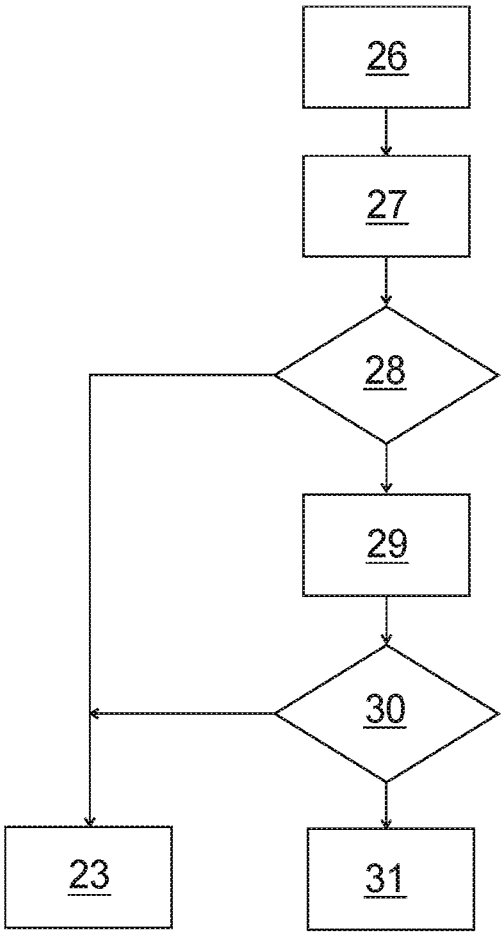
FIG. 3 shows an exemplary brake control sequence in connection with normal stop of an elevator.

FIG. 3 shows an exemplary brake control sequence when normal elevator stop is issued. In normal stop, hoisting motor of elevator car is de-energized and elevator brakes are applied as elevator car arrives to the destination floor.

In step 26, processor 10 receives an elevator normal stop request from elevator traffic controller.

In step 27, processor 10 controls transistors 15 and 16 to cause relays 2 and 3 open. When relays 2, 3 open, current of the magnetizing coils 5A, 5B commutates through the dissipation circuits 40, thereby de-energizing the magnetizing coils 5A, 5B to apply elevator brakes.

In step 28, processor 10 reads the voltage statuses of the second outputs 2"", 3"" with the monitoring circuits 8 and 9. If voltage status in both second outputs changes from off to on, processor 10 concludes that the relays 2 and 3 operate properly and normal stop may proceed to step 29. Otherwise processor 10 determines a brake control failure and proceeds to step 23 to indicate brake control failure and cancel further elevator operation.

In step 29, when brakes have been applied the safety circuit 6 interrupts current supply to control coils 1', 2', 3', which has the effect that also relay 1 opens.

In step 30, processor 10 reads the voltage statuses in the second outputs 1"", 2"", 3"" with the monitoring circuits 7, 8, 9. If voltage in all the second outputs 1"", 2"", 3"" changes as follows:

1"": off→on

2"": on→off

3"": on→off, processor 10 concludes that the relays 1, 2, 3 operate properly and sends a status signal via communication channel 13 to safety circuit 6 indicating that next elevator start is allowed (step 31). On the other hand, if processor determines that signal status of one or more of the second outputs 1"", 2"", 3"" does not change as required, sequence proceeds to step 23 wherein processor 10 determines a brake control failure, cancels elevator operation and sends a fault-indicating signal to safety circuit 6 via the communication channel 13 (or rejects sending of start permit signal).

Emergency Stop

Figure 4:
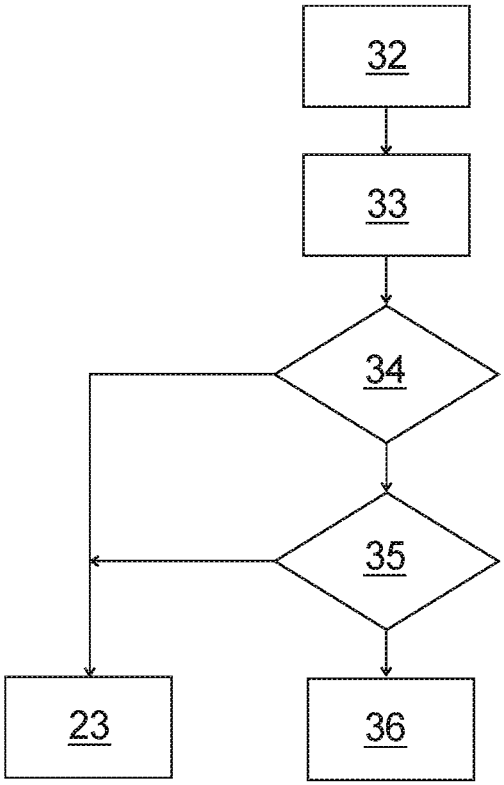
FIG. 4 shows an exemplary brake control sequence in connection with emergency stop of an elevator.

FIG. 4 shows an exemplary brake control sequence when emergency stop of an elevator is issued. In emergency stop situation, elevator brakes are applied as soon as possible for stopping movement of an elevator car. Hoisting motor is also de-energized, but only after certain brake control delay (appx. 150-200 ms) to make sure that elevator brakes have been applied and braking has started before motor torque is removed.

In step 32, processor 10 receives an elevator emergency stop request from safety circuit 6 via the communication channel 13.

In step 33, processor 10 controls transistors 15 and 16 to cause relays 2 and 3 open, thereby de-energizing the magnetizing coils 5A, 5B.

In step 34, processor 10 reads the voltage statuses of the second outputs 2"", 3"" with the monitoring circuits 8 and 9. If voltage status in both second outputs 2"", 3"" changes from off to on, processor 10 concludes that the relays 2 and 3 operate properly, and sequence proceeds to step 35. Otherwise processor 10 determines a brake control failure and proceeds to step 23 to indicate brake control failure and cancel elevator operation.

In step 35, after the brake control delay, when brakes have been applied the safety circuit 6 interrupts current supply to control coils 1', 2', 3', which has the effect that also relay 1 opens. Processor 10 reads the voltage statuses in the second outputs 1"", 2"", 3"" with the monitoring circuits 7, 8, 9. If voltage in all the second outputs 1"", 2"", 3"" changes as follows:

1"": off→on

2"": on→off

3"": on→off, processor 10 concludes that the relays 1, 2, 3 operate properly and sends a start permit signal via communication channel 13 to safety circuit 6 indicating that next elevator start is allowed (step 36). On the other hand, if processor determines that signal status of one or more of the second outputs 1"", 2"", 3"" does not change as required, sequence proceeds to step 23 wherein processor 10 determines a brake control failure, cancels elevator operation and sends a fault-indicating signal to safety circuit 6 via a communication channel 13 (or rejects sending of start permit signal).

Second Embodiment

Figure 5:
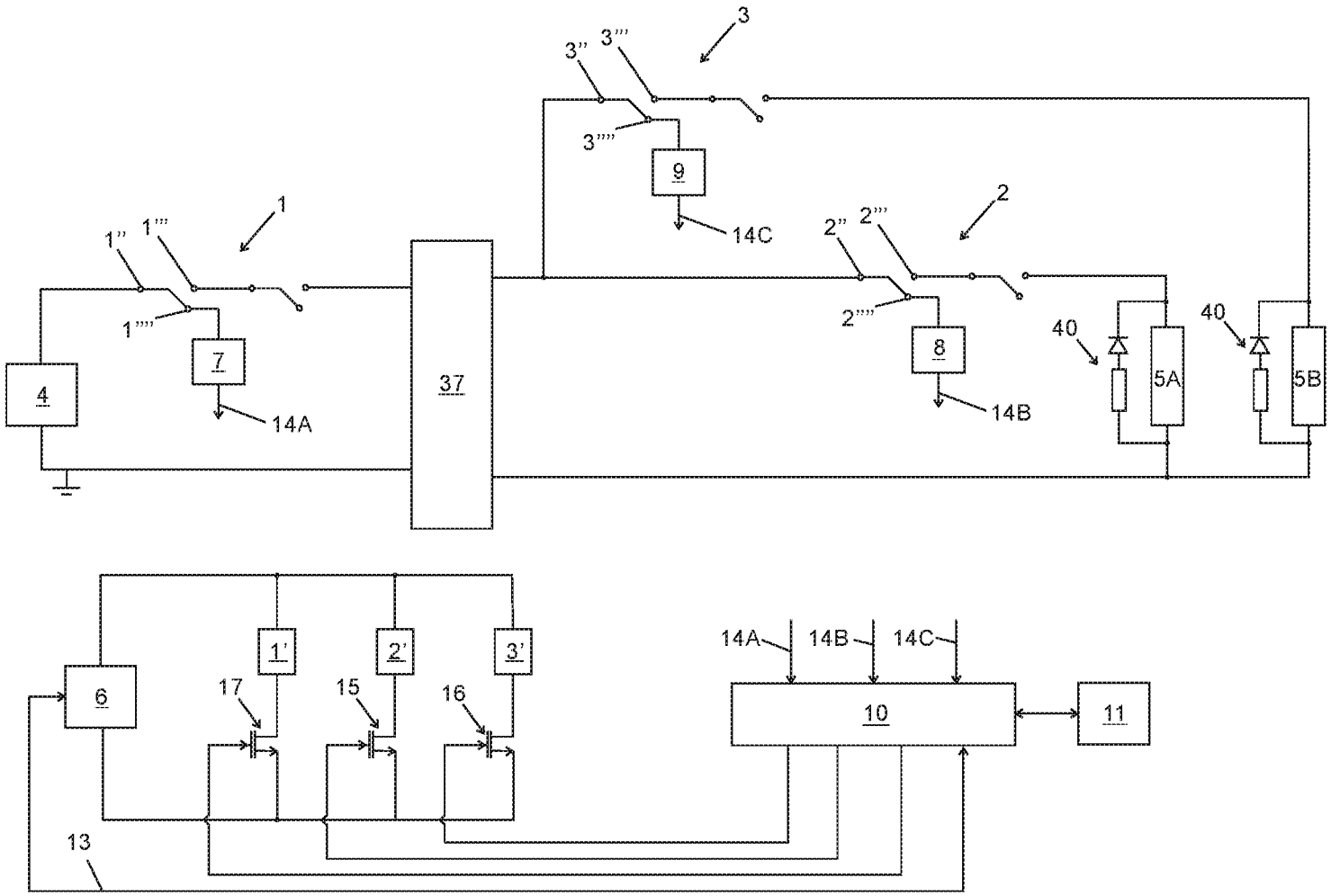
FIG. 5 shows a brake control apparatus according to a second exemplary embodiment.

FIG. 5 shows a brake control apparatus according to second exemplary embodiment. In the second embodiment, in connection with normal elevator stop, relay 1 is opened first while relays 2 and 3 are kept closed. This has the effect that magnetizing coil 5A, 5B current commutates through diode rectifier 37 instead of dissipation circuits 40, causing magnetizing coil current to decrease with a lower decrease rate. Therefore movement of brake armature is slower and noise level when brake armature engages the hoisting machinery is very low, e.g. the brake is more silent.

Monitoring of relays 1, 2, and 3 differs from first embodiment such that in second embodiment operation of relay 1 is monitored in normal stop situation but not in normal start situation. Further, operation of second 2 and third 3 relays is monitored in normal start situation. During emergency stop all relays 1, 2, 3 are monitored as in the first embodiment.

FIG. 5 is a schematic of a main circuit of a brake control apparatus according to a second embodiment. The brake control apparatus of FIG. 5 differs from that of FIG. 1 in such a way that also control coil 1' of the first relay 1 is coupled to the electrical reference ground via a transistor 17, in the same way as control coils 2', 3'. Transistor 17 is also coupled to processor 10 output such that switching state of first relay may be controlled by the processor 10.

Figure 6:
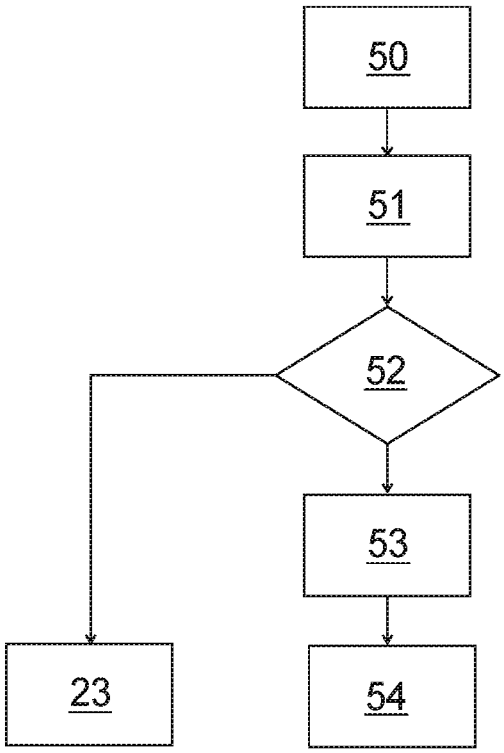
FIG. 6 shows an exemplary brake control sequence in connection with normal stop of an elevator, according to a second exemplary embodiment.

The operation sequence of the brake control apparatus according to second embodiment is disclosed hereinafter in details in connection with three different operating situations: normal elevator start, normal elevator stop and emergency stop of an elevator. Because of similarities, normal start is disclosed in connection with same FIG. 2 and emergency stop is disclosed in connection with same FIG. 4 as in the first embodiment above. FIG. 6 shows normal stop according to second embodiment.

Normal Start

Normal start according to second embodiment is disclosed in connection with FIG. 2.

In step 18 of the brake control sequence, processor 10 receives an elevator run start request from elevator traffic controller.

In step 19, elevator safety circuit 6 determines that elevator safety is not endangered, and enables supply of current to control coils 1', 2', 3'. Processor 10 has already turned on control signal of transistor 17 appx. 2 seconds after previous (successful) elevator stop. Therefore, in step 20, relay 1 closes, conducting mains 4 voltage further to inputs 2", 3" of second 2 and third 3 relays.

If the relays 1, 2 and 3 are operating properly, the voltage status in the second outputs 1"", 2"", 3"" changes in the same way as in embodiment 1:

1"": on→off

2"": off→on

3"": off→on.

In step 21, processor 10 reads the voltage statuses with the monitoring circuits 7, 8, 9. If voltage in all the second outputs 1", 2", 3" changes as required, processor 10 concludes that the relays 1, 2, 3 operate properly. Then the processor 10 controls hoisting motor inverter to energize the hoisting motor. At the same time processor 10 controls transistors 15 and 16 to cause relays 2 and 3 close, thereby energizing the magnetizing coils 5A, 5B to open elevator brakes. After this the normal start sequence proceeds to step 22.

On the other hand, if processor determines that signal status of one or more of the second outputs 1"", 2"", 3"" does not change as required, processor 10 determines a brake control failure and proceeds to step 23 wherein processor cancels elevator operation and sends a fault-indicating signal to safety circuit 6 via the communication channel 13 (or rejects sending of start permit signal).

In step 22, processor 10 reads the voltage statuses of the second outputs 2"", 3"" with the monitoring circuits 8 and 9. If voltage status in both second outputs changes from on to off, processor 10 concludes that the relays 2 and 3 operate properly and normal start may proceed (step 24). Otherwise processor 10 determines a brake control failure and proceeds to step 23 to cancel elevator start.

Normal Stop

Normal stop according to second embodiment is disclosed in connection with FIG. 6.

In step 50, processor 10 receives an elevator normal stop request from elevator traffic controller.

In step 51, processor 10 controls transistor 17 to cause relay 1 open. At the same time, processor 10 controls transistors 15 and 16 to keep relays 2 and 3 closed. When relay 1 opens, current of the magnetizing coils 5A, 5B commutates through the diode (full) bridge rectifier 37, thereby de-energizing the magnetizing coils 5A, 5B to apply elevator brakes in a silent manner.

In step 52, processor 10 reads the voltage status of the first output 1"" with the monitoring circuit 7. If voltage status in first output 1"" changes from on to off, processor 10 concludes that the relay 1 operates properly and normal stop may proceed to step 53. Otherwise processor 10 determines a brake control failure and proceeds to step 23 to indicate brake control failure and cancel further elevator operation.

In step 53, processor 10 controls transistors 15 and 16 to open relays 2 and 3, after a given time delay has passed from opening of relay 1. The given time delay may be for example 150 . . . 200 milliseconds and the purpose of it is to wait until magnetizing coil 5A, 5B currents have vanished and brakes have been applied before opening relays 2 and 3.

In step 54, when brakes have been applied the safety circuit 6 interrupts current supply to control coils 1', 2', 3' to turn the elevator into safe state. In the safe state, brake control by means of processor 10 is blocked.

Emergency Stop

Emergency stop according to second embodiment is disclosed in connection with FIG. 4.

In step 32, processor 10 receives an elevator emergency stop request from safety circuit 6 via the communication channel 13.

In step 33, processor 10 controls transistors 15 and 16 to cause relays 2 and 3 open, thereby de-energizing the magnetizing coils 5A, 5B.

In step 34, processor 10 reads the voltage statuses of the second outputs 2"", 3"" with the monitoring circuits 8 and 9. If voltage status in both second outputs 2"", 3"" changes from off to on, processor 10 concludes that the relays 2 and 3 operate properly, and sequence proceeds to step 35. Otherwise processor 10 determines a brake control failure and proceeds to step 23 to indicate brake control failure and cancel elevator operation.

In step 35, after the brake control delay, when brakes have been applied the safety circuit 6 interrupts current supply to control coils 1', 2', 3', which has the effect that also relay 1 opens. Processor 10 reads the voltage statuses in the second outputs 1"", 2"", 3"" with the monitoring circuits 7, 8, 9. If voltage in all the second outputs 1"", 2"", 3"" changes as follows:

1"": off→on

2"": on→off

3"": on→off, processor 10 concludes that the relays 1, 2, 3 operate properly and sends a start permit signal via communication channel 13 to safety circuit 6 indicating that next elevator start is allowed (step 36). Processor 10 also keeps transistor 17 closed. On the other hand, if processor determines that signal status of one or more of the second outputs 1"", 2"", 3"" does not change as required, sequence proceeds to step 23 wherein processor 10 determines a brake control failure, cancels elevator operation and sends a fault-indicating signal to safety circuit 6 via a communication channel 13 (or rejects sending of start permit signal).

It is obvious to a skilled person that the above-disclosed brake control apparatus may be used to control a brake of an escalator or a conveyor also.

The invention is described above by the aid of exemplary embodiments. It is obvious to a person skilled in the art that the invention is not limited to the embodiments described above and many other applications are possible within the scope of the inventive concept defined by the claims.

The invention claimed is:

1. A brake control apparatus, comprising:

a first switch and a second switch connected in series with each other for selectively supplying current from a power source to an electrically operated actuator of an elevator brake, a control pole of the first switch and a control pole of the second switch being associated with an elevator safety circuit;

wherein the brake control apparatus comprises:

a first monitoring circuit configured to indicate operation of the first switch;

a second monitoring circuit configured to indicate operation of the second switch; and a processor and a memory with a processor-implemented monitoring program stored therein, the processor having inputs coupled to the first monitoring circuit and to the second monitoring circuit as well as an output associated with the control pole of the second switch, the second monitoring circuit is further configured to indicate operation of the first switch while the second switch is open, the control pole of the first switch is coupled to an electrical reference ground via a transistor, and an output of the processor is coupled to the transistor for controlling the first switch.

2. A brake control apparatus according to claim 1, wherein the first switch is a change-over switch and the second switch is a change-over switch.

3. A brake control apparatus according to claim 2, wherein the first change-over switch and the second change-over switch have their inputs as well as first outputs in a current supply path, and wherein a second output of the first change-over switch is coupled to the first monitoring circuit, and a second output of the second change-over switch is coupled to the second monitoring circuit.

4. A brake control apparatus according to claim 1, wherein the first monitoring circuit and the second monitoring circuit are configured to indicate opening and closing of the first switch while the second switch is open.

5. A brake control apparatus according to claim 3, wherein the first switch is fitted in the current supply path closer to the power source than the second switch.

6. A brake control apparatus according to claim 1, wherein the second monitoring circuit is configured to indicate opening of the first switch only when the second switch is open.

7. A brake control apparatus according to claim 1, wherein the monitoring program comprises instructions for comparing operation data of the first switch as received from the first monitoring circuit and the operation data of the first switch as received from the second monitoring circuit to a monitoring criteria, and for indicating an operational anomaly when the operation data does not fulfill the monitoring criteria.

8. A brake control apparatus according to claim 1, wherein the processor has an output for selectively sending a start permit signal to the safety circuit, and the monitoring program comprises instructions for sending a start permit signal when the operation data fulfills the monitoring criteria.

9. A brake control apparatus according to claim 3, wherein the brake control apparatus further comprises a rectifier fitted into the current supply path, for rectifying AC current to DC current for the electrically operated actuator of an elevator brake, wherein the first switch is fitted to an AC side of the rectifier and the second switch is fitted to a DC side of the rectifier.

10. A brake control apparatus according to claim 1, wherein the brake control apparatus comprises a third switch;

there are two elevator brakes each having an electrically operated actuator operable to selectively open or apply the elevator brake;

the third switch is connected in series with the first switch for selectively supplying current from power source to one of the electrically operated actuators, independent of a switching state of the second switch;

the second switch is connected in series with the first switch for selectively supplying current from power source to the other of electrically operated actuators, independent of a switching state of the third switch; and the brake control apparatus comprises a third monitoring circuit configured to indicate operation of the third switch.

11. A brake control apparatus according to claim 1, wherein the electrically operated actuator is an electromagnet of an electromagnetic brake.

12. A brake control apparatus according to claim 7, wherein the first switch and the second switch are relays each having a change-over switch configuration;

the safety circuit is coupled to a control coil of the first relay and the second relay for supplying current to the control coils of the first relay and the second relay; the control coil of the first relay is coupled to the electrical reference ground via the transistor;

the control coil of the second relay is coupled to an electrical reference ground via a second transistor; and an output of the processor is coupled to the second transistor for controlling the second relay.

* * * * *